US005343086A

United States Patent [19]

Fung et al.

[11] Patent Number: 5,343,086

[45] Date of Patent: Aug. 30, 1994

[54] AUTOMATIC VOLTAGE DETECTOR CONTROL CIRCUITRY

[75] Inventors: Wing-Cho Fung, Fremont; Yim Pun; Eric B. Selvin, both of San Jose, all of Calif.

[73] Assignee: Intel Corporation, Santa Clara, Calif.

[21] Appl. No.: 972,760

[22] Filed: Nov. 6, 1992

[51] Int. Cl.[5] ..... G05F 1/565

[52] U.S. Cl. ..... 307/296.1; 307/362; 307/494

[58] Field of Search ..... 307/362, 494, 497, 296.1, 307/296.6, 364, 500, 501, 296.5; 328/157

[56] References Cited

U.S. PATENT DOCUMENTS 4,412,143 10/1983 Patella et al. ..... 307/362
4,438,349 10/1981 Shoji ..... 307/362
4,622,480 11/1986 Uchimura et al. ..... 307/497
4,841,175 6/1989 De Man et al. ..... 307/497
4,965,468 10/1990 Nicollini et al. ..... 307/362

*Primary Examiner*—Timothy P. Callahan
*Assistant Examiner*—My-Trang Nu Ton
*Attorney, Agent, or Firm*—Blakely Sokoloff Taylor & Zafman

[57] ABSTRACT

A voltage detector for providing an indication of the power supply level. The voltage detector includes a differential amplifier which compares the core voltage supply with the peripheral voltage supply. An output stage receives the determination and outputs a signal indicating whether the core voltage supply is the same as the peripheral power supply or whether the two are different.

16 Claims, 3 Drawing Sheets

AUTOMATIC VOLTAGE DETECTOR CONTROL CIRCUITRY

FIELD OF THE INVENTION

The present invention relates to the field of supplying power to integrated circuits; more particularly, the present invention relates to the field of power supply level detection.

BACKGROUND OF THE INVENTION

A large majority of electronic circuits require one or more power supplies for operation. Typically, these power supplies must be stable. However, even though the power supplies are considered stable, the power supply levels generated for some applications usually vary during operation. For instance, a 3.3 volt power supply may generate anywhere from 2.8 volts to 3.7 volts during its operation and still be considered (i.e., rated) a 3.3 volt power supply. Similarly, a 5 volt power supply may generate anywhere from 4.2 to 5.6 volts during its operation and still be considered (rated) a 5 volt power supply. These varying type of power supplies are employed in powering electronic circuitry on computer chips.

Today, certain computer chips are capable of being supplied with two different power supply levels. For instance, a chip may be supplied with either a 5 volt or a 3.3 volt power supply. Furthermore, certain chips in the market today utilize different power supply levels for different portions of the chip. In other words, a portion of the chip may be powered by a power supply at one level (e.g., 5 volt supply), while another portion of the chip is powered by a power supply at a different level (e.g., 3.3 volt supply). Also a portion of the chip may be powered by a power supply at one level (e.g., 3.3 volt supply), while another portion of the chip is capable of being supplied with more than one power supply level (e.g., 3.3 volts or 5 volts).

Some of the circuitry on these dual or multi-power supply level chips are sensitive to the power supply level under which they operate. For instance, circuitry powered at one level may not operate in the same manner when powered at another level. For example, if an input buffer were powered by multiple power supply levels, its trip points would be effected by the change in the level, such that the trip point would be different for the different power supply levels. These circuitries must be able to compensate for the differences in the power supply levels. Also these circuitries would also need an indication of the power supply level. For example, trip-point selection circuitry would be needed to set the trip point for the input buffers according to whether the chip is being powered by one power supply level (i.e., 3.3 volts) or another power supply level (i.e., 5 volts). In these instances, the circuits must be programmed according to the power supply level which is being utilized.

In the prior art, these power supply level dependent circuits can be programmed in one of two ways. First, a set of registers located on the chip itself is available for the user to program the level of the power supply currently being used. Depending on how the user programs the register, the circuitry is able to compensate for the various power supplies levels which can be received. However, the use of registers on-chip requires the use of memory storage on-chip. Memory storage is limited on-chip and generally there is a need to limit the use of on-chip memory. Furthermore, the use of these on-chip registers requires the time of a system designer to program them.

Second, external pins may be used to indicate to the chip the level of the power supply being used. For instance, when a single pin is used to indicate the power supply level for a chip, the chip is capable of operating at two different power supply levels. When the pin is in one state (e.g., a logical 0), the power supply level is at a first level, while if the pin is in the other state (e.g., a logical 1), then the power supply is at a second level. If multiple portions of a chip are capable of operating at different power levels, then each separate portion would require a separate pin. The number of pins on a chip directly affects the size of the chip. The more pins a chip has, the larger it is. To minimize the chip size, the number of pins must be reduced. Thus, there is a need to allow a chip, or portion thereof, to be powered by more than one power supply level, while keeping the pin count down.

In the prior art, especially with respect to power level sensitive input buffer circuitry, the basic input/output system (BIOS) is used to determine the chip power supply. Where a chip is capable of operating at a two power supply levels (e.g., a 3.3 or 5 volt power supply), the BIOS writer must write two versions of the BIOS, one for operating with one power supply level (e.g., 3 volt) and one for operating with the other power supply level (e.g., 5 volt). It is desirable to have the voltage supply level automatically sensed at power-up for the voltage sensitive circuitry, such that no work is required from the BIOS writer. Furthermore, the trip-points of input buffers are not properly set until approximately 50 prefetch cycles have been completed and after the input to the chip has been used for internal operation. Moreover, in the prior art, as the input trip-point is not set properly until a certain number of prefetch cycles, the wrong trip-point may be used, causing the chip to hang and never recover. Also, if the BIOS programs the trip-point improperly, the chip may not work as expected. It is desirable to start sensing power immediately after power-up and also to select the trip-point of the input buffer before any input is sampled. This almost guarantees that the chip will function properly.

As will be shown, the power supply level detector of the present invention eliminates the need to have on-chip programmable registers to indicate to the chip the power supply level. Also the power supply level detector of the present invention eliminates the need to use external pins to program circuitry requiring knowledge of the power supply level to operate correctly. The power supply level detector of the present invention senses the peripheral power supply of the I/O buffers to determine what power supply is applied to the chip during the power-up reset sequence. Once the power supply of the I/O buffers is determined, the present invention sets the trip point of the buffers automatically. Furthermore, after setting the trip-point, the present invention shuts itself off to save power.

SUMMARY OF THE INVENTION

A circuit for detecting the voltage supply level on an integrated circuit is described. The voltage detector includes a differential amplifier and output circuitry. The differential amplifier compares two voltage supplies, a first at a predetermined voltage supply level and a second at either the predetermined voltage supply level or at another voltage supply level. The differential amplifier outputs a signal which indicates whether the power supply level of the second is at the predetermined power supply level or is at another voltage supply level. The output circuitry receives the signal from the differential amplifier and generates a signal which indicates the level of the second voltage supply.

In another embodiment of the present invention, the voltage detector circuitry includes circuitry to disable the differential amplifier and output circuitry after the output circuitry indicates the level of the second voltage supply. Also in another embodiment of the present invention, the voltage detector circuitry includes circuitry to retain the voltage supply indication from the output circuitry when the differential amplifier and output circuitry have been disabled.

BRIEF DESCRIPTION OF THE DRAWINGS

The present invention will be understood more fully from the detailed description given below and from the accompanying drawings of the preferred embodiment of the invention, which, however, should not be taken to limit the invention to the specific embodiments, but are for explanation and understanding only.

DETAILED DESCRIPTION OF THE INVENTION

A voltage detector control circuitry is described. In the following description, numerous specific details are set forth, such as specific voltages, transistor sizes, etc., in order to provide a thorough understanding of the preferred embodiment of the present invention. It will be obvious to those skilled in the art that the present invention may be practiced without these specific details. Also, well-known circuits have been shown in block diagram form, rather than in detail, in order to avoid unnecessarily obscuring the present invention.

Overview of the Computer System of the Present Invention

Figure 1:
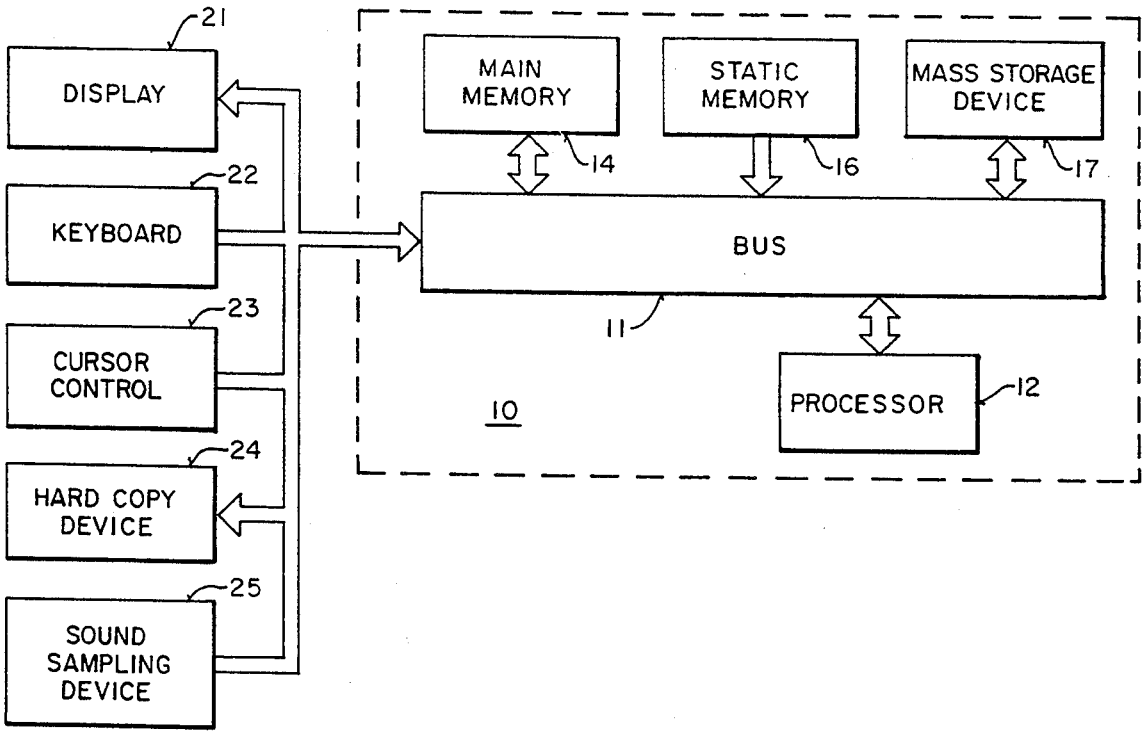
FIG. 1 is a block diagram of the computer system of the present invention.

Referring to FIG. 1, an overview of a computer system of the present invention is shown in block diagram form. It will be understood that while FIG. 1 is useful for providing an overall description of the computer system of the present invention, a number of details of the system are not shown. As necessary for disclosure of the present invention, further detail is set forth with reference to the other figures provided with this specification. Further, the present invention is described with reference to its preferred embodiment; alternative embodiments which may be conceived by one of ordinary skill in the art are considered within the scope of the claims set forth below.

As illustrated in FIG. 1, a computer system, as may be utilized by the preferred embodiment of the present invention, generally comprises a bus or other communication means 11 for communicating information, a processing means 12 coupled with bus 11 for processing information, a Random Access Memory (RAM) or other dynamic storage device 14 (commonly referred to as a main memory) coupled with bus 11 for storing information and instructions for processing means 12, a Read Only Memory (ROM) or other non-volatile storage device 16 coupled with bus 11 for storing non-volatile information and instructions for processing means 12, a data storage device 17, such as a magnetic disk and disk drive, coupled with bus 11 for storing information and instructions, a display device 21, such as a cathode ray tube, liquid crystal display, etc., coupled to bus 11 for displaying information to the computer user, an alpha-numeric input device 22 including alpha-numeric and other keys, etc., coupled to bus 11 for communicating information and command selections to processor 12 and a cursor control 23 for controlling cursor movement. The system also includes a hard copy device 24, such as a plotter or printer, for providing a visual representation of the computer images. Hard copy device 24 is coupled with processor 12, main memory 14, non-volatile memory 106 and mass storage device 17 through bus 11. Finally, the system includes a sound recording and playback device 25 for providing audio recording and playback.

Of course, certain implementations and uses of the present invention may not require nor include all of the above components. For example, in certain implementations a keyboard and cursor control device for inputting information to the system may not be required. In other implementations, it may not be required to provide a display device for displaying information.

Processor 100 is utilized in conjunction with a computer system which generally includes a bus, a main memory, a static memory, a display device, an alphanumeric input device, and a hardcopy device (all of which are not shown in order to avoid confusion). Of course, certain computer system implementations and uses of the present invention may not require nor include all of these components.

Figure 2:
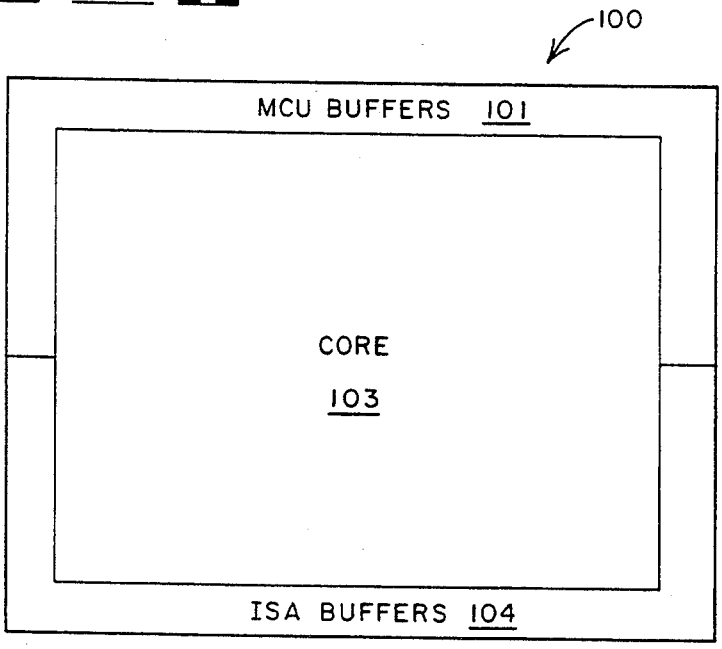
FIG. 2 is a block diagram of the microprocessor of the present invention.

FIG. 2 shows a block diagram of microprocessor 100 utilized by the preferred embodiment of the present invention. Processor 100 is preferably manufactured as an integrated circuit using a metal-oxide semiconductor (MOS) process. Referring to FIG. 2, processor 100 generally comprises core unit 103. Core unit 103 includes logic and circuitry for processing data, an industry standard architecture (ISA) or a bus control unit for controlling communication of processor 100 with the bus of the computer system, and a memory control unit (MCU) for controlling communication of processor 100 with the main memory of the computer system. Processor 100 also includes MCU buffers 101 for buffering data between the MCU portion of core unit 103 and the peripheral memory devices of the computer system. Processor 100 also includes ISA buffers 104 for buffering communication between core unit 103 and the bus and the associated peripheral devices of the computer system. Core 103, MCU buffers 101 and ISA buffers 104 are coupled together using system bus and control signal path (not shown) in a manner well-known in the art.

In the present invention, core unit 103, MCU buffers 101 and ISA buffers 104 are all powered by individual power supply levels. In the currently preferred embodiment, core unit 103 is capable of operating at only one power supply level. In the currently preferred embodiment, core unit 103 is powered by a 3.3 volt power supply. In the present invention, MCU buffers 101 and ISA buffers 104 are capable of operating at multiple power levels. In the currently preferred embodiment, MCU buffers 101 and ISA buffers 104 are capable of operating with power supplies of either 3.3 or 5 volts. Thus, in the currently preferred embodiment, it is possible that a portion of processor 100 is being powered by a 3.3 volt power supply (e.g., core unit 103), while another portion (e.g., MCU buffers 101 and/or ISA buffers 104) is powered by a 5 volt power supply.

It should be noted that although the power supply levels are 3.3 volt and 5 volt power supplies, the power supply levels actually vary from their rated 3.3 volt and 5 volt values, even though the power supplies are considered 3.3 volt and 5 volt power supplies respectively. For instance, in the case of 3.3 volts, the power supply level is capable of ranging from 2.8 to 3.7 volts, yet still is considered a 3.3 volt power supply. Similarly, in the case of 5 volts, the power supply level is capable of ranging from 4.2 to 5.6 volts, yet still is considered a 5 volt power supply.

Some of the circuitry in both MCU buffers 101 and ISA buffers 104 must know the level of the power supply which is currently being used to power their operation, e.g., whether it be 3.3 or 5 volts. For instance, MCU buffers 101 and ISA buffers 104 must know the power supply level in order to properly set the trip-points of the buffers. Separate circuitry in both MCU buffers 101 and ISA buffers 104 determines the power supply level. In the present invention, the circuitry determines the level of the power supply by comparing the power supply level to a known power supply level (i.e., a predetermined power supply level). In the currently preferred embodiment, the predetermined power supply level is that of core unit 103 which only operates at one level, such that each of the power supply levels is compared against the power supply level of core unit 103. The result of the comparison is a signal which indicates the power supply level which is currently being used. Once the voltage level of the power supply, the trip point of the buffers can be set to operate correctly for the voltage supply level.

It should be noted that the following discussion only focuses on the determination of the power supply level for MCU buffers 101. However, the present invention could also be used to identify the power supply level for ISA buffers 104 or any other circuitry that must know the level of the power supply that is powering their operation.

Figure 3:
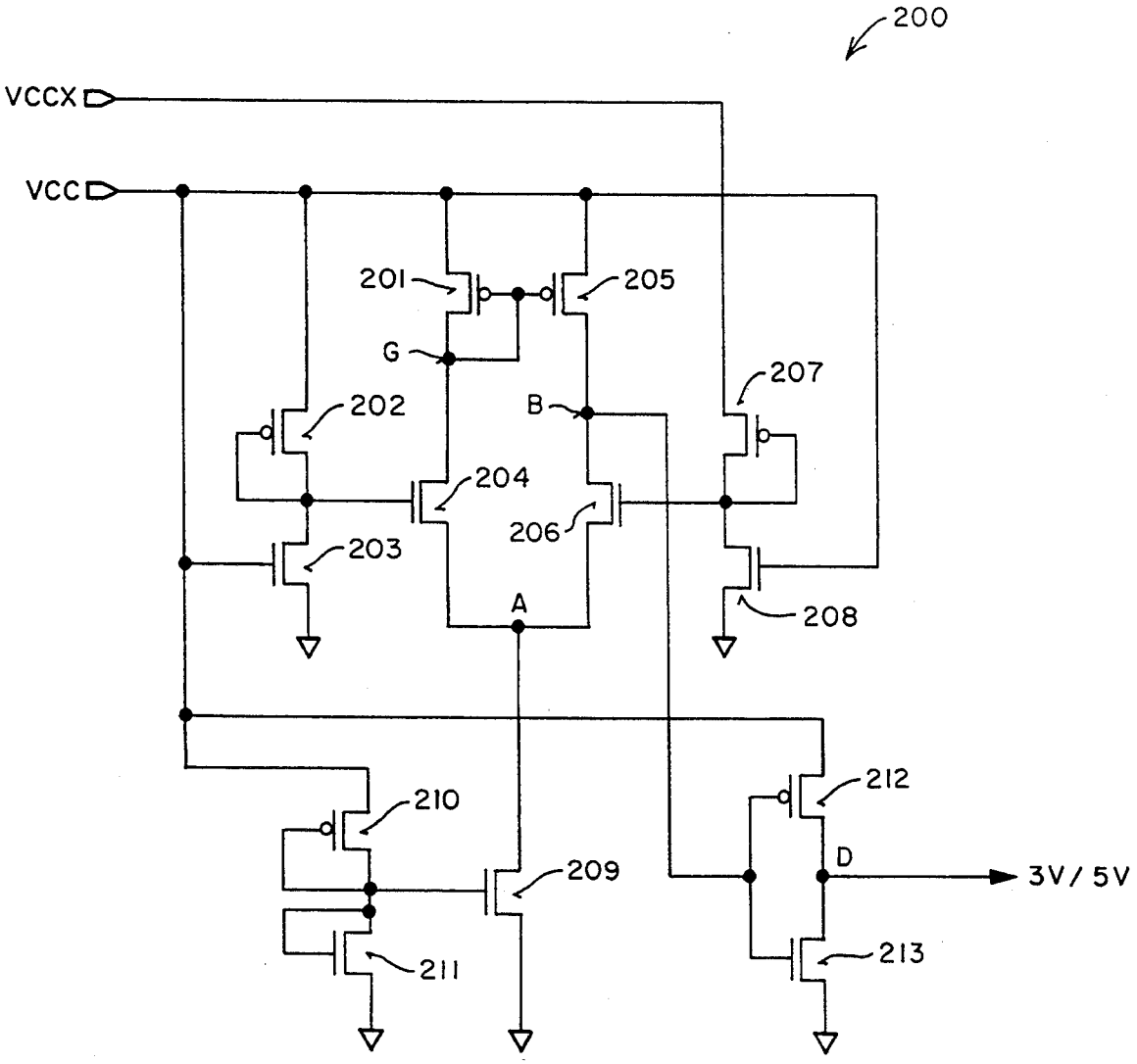
FIG. 3 illustrates a circuit schematic of the voltage detector control circuitry of the present invention.

FIG. 3 illustrates the voltage detector control circuitry of the present invention. Voltage detector control circuitry 200 comprises p-channel devices 201, 202, 205, 207, 210, and 212, and n-channel devices 203, 204, 206, 208, 209, 211 and 213. In the currently preferred embodiment, each of the devices is a metal-oxide semiconductor (MOS) transistor. Control circuitry 200 receives both the core voltage supply VCC and the voltage supply of the peripheral devices (i.e., the buffers) VCCX. Control circuitry 200 outputs a signal which indicates the voltage level of the power supply. In the currently preferred embodiment, control circuitry 200 outputs a 3 volt/5 volt (3 V/5 V) signal indicating whether the power supply of the peripheral devices (i.e., the power supply level which powers their operation) is 3.3 volts or 5 volts.

Referring to FIG. 3, the source of device 202 is coupled to the core voltage supply VCC. In the present invention, the core voltage supply VCC is only one voltage supply. In the currently preferred embodiment, the core voltage supply is a 3.3 volt supply. The gate and the drain of device 202 are coupled to the gate of device 204. The drain of device 203 is also coupled to the gate of device 204. The gate of device 203 is coupled to the core voltage supply VCC. The source of device 203 is coupled to Vss (i.e., ground). The drain of device 204 is coupled to node A, while its source is coupled to the gates of devices 201 and 205 and the drain of device 201 at node G. The source of device 201 is coupled to the core supply voltage VCC. The gate of device 201 is also coupled to the gate of device 205.

The source of device 207 is coupled to the peripheral voltage supply VCCX. In the present invention, the peripheral power supply VCCX is capable of being at more than one voltage level supply. In the currently preferred embodiment, the peripheral voltage supply is capable of being either a 3.3 or 5 volt power supply. The gate and the drain of device 207 are coupled to the gate of device 206. The drain of device 208 is also coupled to the gate of device 206. The gate of device 208 is coupled to the core voltage supply VCC. The source of device 208 is coupled to Vss (i.e., ground). The drain of device 206 is coupled to node A, while its source is coupled to the drain of device 205 at node B. The source of device 205 is coupled to the core supply voltage VCC.

The drain of device 209 is coupled to node A. The source of device 209 is coupled to Vss (i.e., ground). The gate of device 209 is coupled to the drains and gates of devices 210 and 211. The source of device 211 is coupled to Vss (i.e., ground). The source of device 210 is coupled to the core supply voltage VCC.

Node B is coupled to the gates of devices 212 and 213. The drains of devices 212 and 213 are coupled to the output of voltage detector control circuitry (i.e., node D). The source of device 212 is coupled to the core voltage supply VCC. The source of device 213 is coupled to Vss (i.e., ground).

Devices 201, 204–206 and 209 form a differential amplifier with an active load current mirror. The inputs of the differential amplifier are the gates of devices 204 and 206. In one embodiment, the differential amplifier formed by devices 201, 204–206, and 209 is symmetrical. That is, devices 204 and 206 are the same size. In the currently preferred embodiment, devices 204 and 206 have a channel width of 20 $\mu$ and a channel length of 5 $\mu$. The active load current mirror comprises devices 201 and 205. Note that in the present invention the size of devices 201 and 205 are chosen arbitrarily. In the currently preferred embodiment, devices 201 and 205 have a channel width of 20 $\mu$ and a channel length of 10 $\mu$. In one embodiment, devices 201 and 205 are diodes.

Devices 209–211 comprise the current source portion of the differential amplifier. In the present invention, the current source portion of the differential amplifier matches the current produced in the upper portion of the differential amplifier. The matching of currents is attained in the currently preferred embodiment by device sizing. Furthermore, the current source portion is sized to permit as much of a voltage swing as possible, yet still having a voltage at node A of approximately 0 volts.

In the currently preferred embodiment, device 209 has a channel width of 40 $\mu$ and a channel length of 11 $\mu$. The size of device 209 requires a low voltage to keep it in saturation. In the present invention, devices 210 and 211 provide a potential to the gate of device 209 to keep device 209 in saturation. Device sizing allows devices 210 and 211 to provide the low voltage. In the currently preferred embodiment, the gate voltage provided by devices 210 and 211 is 1.3 volts. Therefore, in the currently preferred embodiment, the sizes of devices 210 and 211 are chosen such that a 1.3 volts potential is applied to the gate of device 209. In the currently preferred embodiment, device 210 has a channel width of 20 μ and a channel length of 20 μ, while device 211 has a channel width of 20 μ and a channel length of 10 μ.

The output of the differential amplifier is taken at node B and outputted into an inverter formed by devices 212 and 213. The output of the inverter is the output of the voltage detector control circuitry 200 (the 3 V/5 V signal).

When the computer system is powering up (i.e., not in a power down or reduced power consumption mode), voltage detector control circuitry 200 is on. When voltage detector control circuitry 200 is on, devices 202 and 203 form a voltage reference to one of the inputs of the differential amplifier formed by devices 201, 204–206 and 209. In the present invention, the sizes of devices 202 and 203 are such that a voltage reference of VCC/2 is provided to the differential amplifier.

In the currently preferred embodiment, since the core voltage supply is 3.3 volts, the sizes of devices 202 and 203 are chosen, such that a voltage reference of approximately 1.65 volts is provided to one input of the differential amplifier. Note that the voltage reference is not exactly 1.65 volts since the voltage supply can provide potential ranging from 2.8 to 3.7 volts. In the currently preferred embodiment, device 202 has a channel width of 20 μ and a channel length of 5 μ, while device 203 has a channel width of 5 μ and a channel length of 30 μ.

Devices 207 and 208 provide the other voltage input for the differential amplifier. In the present invention, the sizes of devices 207 and 208 are chosen such that if the supply voltages of VCC and VCCX are the same, the input voltage to the differential amplifier produced by devices 207 and 208 will be less than or equal to that of devices 202 and 203. In other words, in the currently preferred embodiment, the voltage input produced by devices 207 and 208 is always less than or equal to 1.65 volts when the supply voltage VCCX of the peripheral devices is 3.3 volts. In the currently preferred embodiment, device 207 has a channel width of 20 μ and a channel length of 5 μ. Device 208 has a channel width of 5 μ and a channel length of 18 μ. Note that in the present invention, for voltage detector control circuitry 200 to operate correctly, VCC is greater than or equal to VCCX.

It should be noted that when the differential amplifier formed by devices 201, 204–206 and 209 is operational, DC current flows through both voltage references. By allowing current to flow through each voltage reference, the current "leaks" from the differential amplifier. The leakage of the current allows differences between the voltage supplies to be magnified, such that the comparison made between the two supply voltages is accentuated. Therefore, the voltage detector of the present invention magnifies the difference between the core voltage VCC and the unknown voltage VCCX.

The present invention magnifies the difference between the core voltage VCC and the unknown voltage VCCX, even though the power supplies vary across a range of voltages. In the currently preferred embodiment, the differential amplifier must be able to output a logical 0 (i.e., a low) when the core voltage VCC is 3.7 volts and the unknown peripheral voltage is 4.2 volts. Note that the 3.7 volts is still within the rated voltage range of a 3.3 volt power supply. Also in the currently preferred embodiment, the differential amplifier outputs a logical 1 (i.e., a high) when there is no difference between the supplies. In the currently preferred embodiment, the peripheral voltage supply VCCX is derived from the core voltage supply VCC, and thus, VCCX is always less than or equal to VCC.

When the differential amplifier formed by devices 201, 204–206 and 209 is comparing the supply voltage VCC to the peripheral supply voltage VCCX, a potential is generated at node B. If the supply voltages VCC and VCCX are both 3.3 volt supplies, then the current created in both sides of the differential amplifier will be approximately the same. If the supply voltages of VCC and VCCX differ and the supply voltage VCCX is larger than the supply voltage VCC, then the current traveling through devices 205 and 206 is larger than the current traveling through devices 201 and 204. A larger current traveling through devices 205 and 206 results in a drop in potential at node B. The voltage at node B is the output signal of the differential amplifier.

In the present invention, the output signal (i.e., the potential at node B) is received by an output stage which generates a signal (at node D) that is indicative of the peripheral voltage supply. In the currently preferred embodiment, if the output produced by the output stage is a logical 1, then the peripheral supply voltage is a 5 volt supply voltage. If the output produced by the output stage is a logical 0, then the peripheral supply voltage is a 3.3 volt supply voltage.

In the currently preferred embodiment, the output stage comprises an inverter formed from devices 212 and 213. The gates of devices 212 and 213 form the input of the inverter, while the drains of devices 212 and 213 (i.e., node D) is the output. When the supply voltage VCCX is a 5 volt supply and VCC is 3.3 volts, more current flows through devices 205 and 206, thereby lowering the potential at node B. The voltage being low causes device 212 to pull-up the output at node D. In this situation, device 213 is off and not conducting current. Thus, if VCCX is a 5 volt supply, then the output of the voltage detector control circuitry 200 will be high. However, if the supply voltage VCCX is the same as VCC, the same current flows through devices 201 and 204 as does 205 and 206, thereby causing the potential at node B to be higher. The higher potential at node B turns on device 213, causing node D to be pulled to ground. In this situation, device 212 is off and not conducting current. Thus, if VCCX is a 3.3 volt supply, then the output of voltage detector control circuitry 200 will be low.

Figure 4:
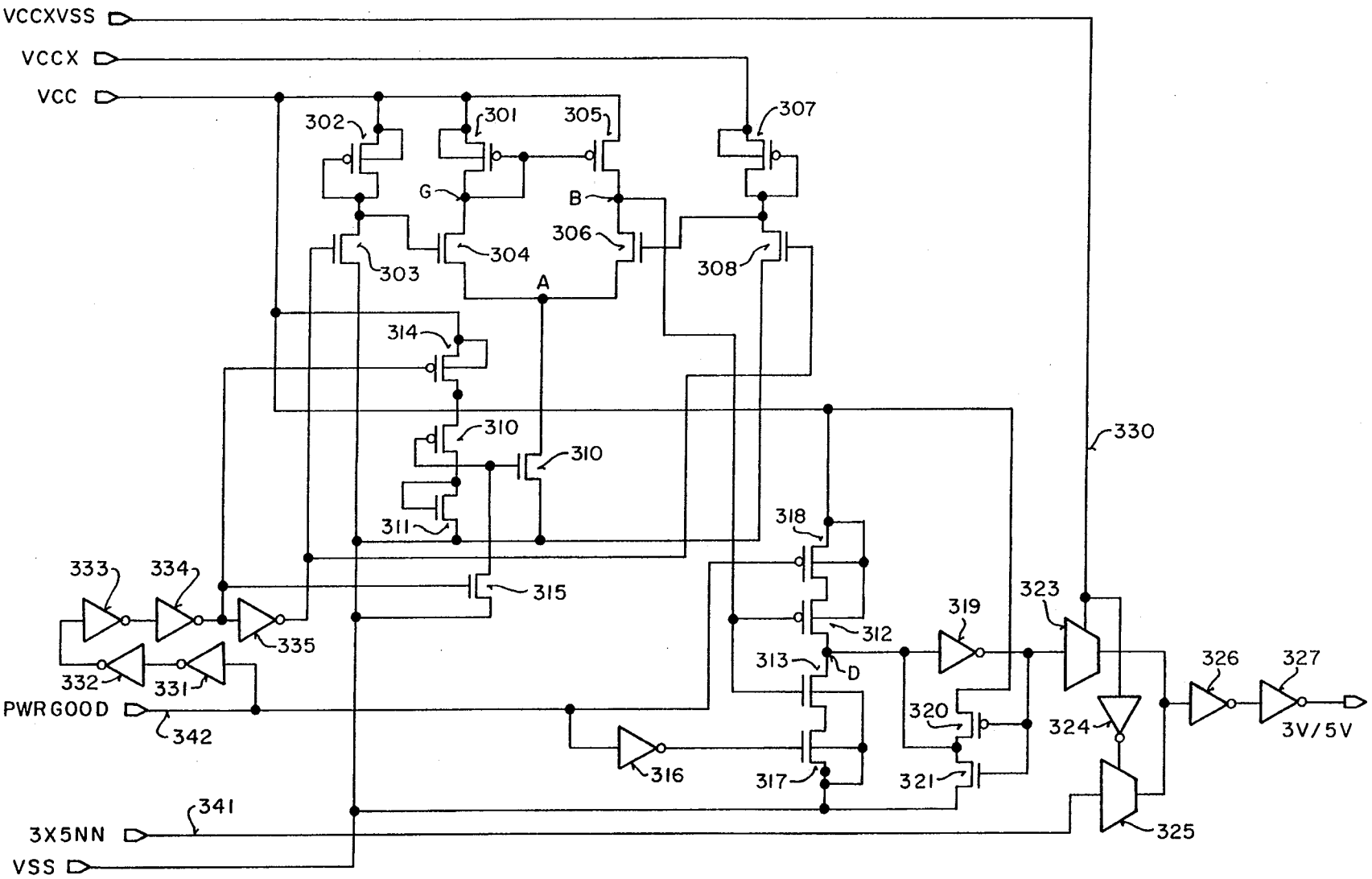
FIG. 4 illustrates the currently preferred embodiment of the circuit schematic of the voltage detector control circuitry of the present invention.

FIG. 4 depicts the currently preferred embodiment of the voltage detector control circuitry of the present invention. Referring to FIG. 4, voltage detector control circuitry 300 comprises p-channel devices 301, 302, 305, 307, 310, 312, 314, 318 and 320, n-channel devices 303, 304, 306, 308, 309, 311, 313, 315, 317, and 321, inverters 316, 319, 324, 326, 327, and 331–335, and pass gates 323 and 325. In the currently preferred embodiment, the p-channel and n-channel devices are MOS transistors. The gate and the drain of device 302 are coupled to the gate of device 304. The source of device 302 is coupled to the core voltage supply VCC. The drain of device 303 is also coupled to the gate of device 304. The gate of device 303 is coupled to the output of inverter 335. The source of device 303 is coupled to Vss (i.e., ground). The drain of device 304 is coupled to node A, while its source is coupled to the gates of devices 301 and 305 and the drain of device 301 at node G. The source of device 301 is coupled to the core supply voltage VCC. The gate of device 301 is also coupled to the gate of device 305.

The source of device 307 is coupled to the peripheral voltage supply VCCX. In the present invention, the peripheral power supply VCCX is capable of being at more than one voltage level supply. In the currently preferred embodiment, the peripheral voltage supply is capable of being either a 3.3 volt or 5 volt power supply. The gate and the drain of device 307 are coupled to the gate of device 306. The drain of device 308 is also coupled to the gate of device 306. The source of device 308 is coupled to Vss (i.e., ground). The gate of device 308 is coupled to the output of inverter 335. The drain of device 306 is coupled to node A, while its source is coupled to the drain of device 305 at node B. The source of device 305 is coupled to the core supply voltage VCC.

The drain of device 309 is coupled to node A. The source of device 309 is coupled to Vss (i.e., ground). The gate of device 309 is coupled to the drains and gates of devices 310 and 311. The source of device 311 is coupled to Vss (i.e., ground). The source of device 310 is coupled to the drain of device 314. The gate of device 314 is coupled to the output of inverter 334. The source of device 314 is coupled to the core power supply voltage VCC. Also coupled to the gate of device 309 is the drain of device 315. The gate of device 315 is coupled to the output of inverter 334. The source of device 315 is coupled to Vss (i.e., ground).

The output of inverter 334 is coupled to the input of inverter 335. The input of inverter 334 is coupled to the output of inverter 333. The input of inverter 333 is coupled to the output of inverter 332. The input of inverter 332 is coupled to the output of inverter 331. The input of inverter 331 is coupled to the PWRGOOD signal (line 342).

Node B is coupled to the gates of devices 312 and 313. The drains of devices 312 and 313 are coupled to node D. The source of device 312 is coupled to the drain of device 318. The gate of device 318 is coupled to the PWRGOOD signal (line 342), and the source of device 318 is coupled to core supply voltage VCC. The source of device 313 is coupled to the drain of device 317. The gate of device 317 is coupled to the output of inverter 316. The input of inverter 316 is coupled to the PWRGOOD signal (line 342). The source of device 317 is coupled to Vss (i.e., ground).

Node D is coupled to the input of inverter 319 and the drains of device 320 and 321. The gates of devices 320 and 321 are coupled to the output of inverter 319. The source of device 320 is coupled to the core supply voltage VCC. The source of device 321 is coupled to Vss (i.e., ground).

The output of inverter 319 is also coupled to the input of pass gate 323. Pass gate 323 is also coupled to receive a signal on line 330 (the VCCXVSS signal), which acts as a control input. Signal 330 is also coupled to the input of inverter 324. The output of inverter 324 is coupled as a control input to pass gate 325. The input of pass gate 325 is coupled to a 3 V/5 VNN signal. The outputs of pass gates 323 and 325 are coupled together as an input to inverter 326. The output of inverter 326 is coupled to the input of inverter 327. The output of inverter 327 is the output of voltage detector control circuitry 300. In other words, the output of inverter 327 is the 3 V/5 V signal.

Devices 301–313 operate in the same manner as devices 201–213 respectively of FIG. 3, with the exception of the influence of the PWRGOOD signal (line 342) and its associated circuitry in disabling the differential amplifier portion and the latch portion (i.e., output portion in FIG. 2) after the latch potion produces an output at node D. Devices 301, 304–306 and 309 form the same differential amplifier having the gates of devices 304 and 306 by its inputs. The voltage references are provided to the gates of devices 304 and 306 by devices 302 and 303 and devices 307 and 308, respectively. Furthermore, devices 310 and 311 provide a potential to the gate of device 309, such that a current source is created. Device 312 and 313 form the same latch as devices 212 and 213. The voltage detection control circuitry 300 also includes circuitry which allows it to be powered down once an indication of the voltage level of the peripheral power supply has been given.

The PWRGOOD signal indicates when the integrated circuit is powered up. In the currently preferred embodiment, once the voltage supplies have been turned on, the integrated circuit is busy powering up. While powering up the integrated circuit enters into reset, which is well-known in the art. In the currently preferred embodiment, when the integrated circuit is powering up and is in reset, the PWRGOOD signal is a logical 0 (i.e., low). In the currently preferred embodiment, when the voltage supplies have reached a level at which the integrated circuit can function properly, the power is "good" and is indicated by the PWRGOOD signal being a logical 1 (i.e., high).

When the PWRGOOD signal is low, a delay is produced by inverters 331–335. The output of inverter 335 will be a logical 1, (i.e., high). The high output of inverter 335 causes devices 303 and 308 to be on, such that a proper input voltage is received on the gates of devices 304 and 306 respectively. Similarly, when the PWRGOOD signal is low, the output of inverter 334 will be a logical 0 (i.e., low), which causes device 315 to be off and device 314 to be on. Device 314 being on causes device 310 to be sourced with current, thereby allowing the proper voltage to be applied to the gate of device 309 so that device 309 can act as a current source.

The PWRGOOD signal being low also enables the latch created by devices 312 and 313. When the PWRGOOD signal is low, device 318 is on, thereby allowing device 312 to be sourced with the core supply voltage VCC. Similarly, when the PWRGOOD signal is low, the output of inverter 316 is high, causing device 317 to be on and source device 313 with Vss (i.e., ground). Thus, when the PWRGOOD signal is a logical 0 (i.e., low), the differential amplifier and latch portions of voltage detector control circuitry 300 are enabled.

When the power reaches the functional level and the integrated circuit has been reset, the PWRGOOD signal goes to a logical 1 (i.e., high). When the PWRGOOD signal is high, the output of inverter 335 is a logical 0 (i.e., low). When the output of inverter 335 is a logical 0, devices 303 and 308 are off, such that they are not conducting current. When devices 303 and 308 are off, devices 302 and 307 cannot be turned on nor can be conducting current. Since devices 302 and 307 are off, the inputs to the differential amplifier portion of voltage detector control circuitry 300 are low. When the PWRGOOD signal goes to a logical 1, the output of inverter 334 is low causing device 314 to be off and device 315 to be on. When device 314 is off, device 310 is not sourced with any current, such that it cannot provide a gate voltage for device 309. When device 315 is on, it pulls the gate of device 309 to ground, such that device 309 is off and not conducting any current. Since device 309 is not conducting current, then the differential amplifier portion of voltage detector control circuitry 300 does not have a current source, and is therefore disabled.

When the PWRGOOD signal is a logical 1, (i.e., high), devices 318 and 317 are off, such that devices 312 and 313 are not sourced current. Thus, when the PWRGOOD signal is a logical 1, the latch formed by devices 312 and 313 is disabled.

When the PWRGOOD signal is a logical 1 (i.e., high), the differential amplifier and latch portions are disabled. Even though these portions are disabled, the signal which was output by the latch formed by devices 312 and 313 is retained in the keeper circuitry formed by inverter 319, p-channel device 320 and n-channel device 321.

When the output of the latch is a logical 0, the output of inverter 319 is a logical 1. The logical 1 (high) output from inverter 319 causes device 321 to turn on, which pulls the input of inverter 319 to ground (i.e., a logical 0 corresponding to the original output at node D). Thus, in this manner, the logical 0. output of the latch is retained by the keeper circuitry. Similarly, when the output of the latch is a logical 1, the output of inverter 319 is a logical 0. The logical 0 output of inverter 319 causes device 320 to be on, which pulls the input of inverter 319 high (i.e., to the level of the core voltage supply VCC). Thus, in this manner, the logical 1 output of the latch is retained by the keeper circuitry. Therefore, when control circuitry 300 has been powered down, the signal indicating the voltage level of the peripheral power supply is retained.

The output of the keeper circuitry (i.e., the output of inverter 319) is input into one input of a multiplexer formed by pass gates 323 and 325 and inverter 324. The other input of the multiplexer is from a signal (3 V/5 VNN) via line 341 which indicates whether the peripheral voltage supply is a 3.3 or 5 volt power supply. The 3 V/5 VNN signal could be derived from a configuration register or other indicative source (e.g., a pin). In the currently preferred embodiment, the 3 V/5 VNN (line 341) is received by pass gate 325. The output of the multiplexer is controlled by control signal 330. In the currently preferred embodiment, control signal 330 controls which of the pass gates, either pass gate 323 or pass gate 325, will output its input. In the currently preferred embodiment, if control signal 330 is a logical 1 (i.e., high), then pass gate 323 passes its input signal (i.e., the signal output from inverter 319) on its input. However, if control signal 330 is a logical 0 (i.e., low), then pass gate 325 passes the signal on its input. Control signal 330 will be low when the power supply information is known or has been already programmed.

Inverters 326 and 327 provide a delay to the output produced by the remainder of control circuitry 300. The output of pass gates 323 and 325, which indicates whether the peripheral power supply is a 3.3 or 5 volt supply, is input into inverter 326, which inverts it. The inverted signal is then inverted again by inverter 327, such that the logical state of the signal output from inverter 327 is the same as it was when output from either pass gate 323 or 325. In this manner, inverters 326 and 327 delay the output of control circuitry 300 by two logic delays.

Therefore, voltage detector control circuitry 300 of the present invention automatically senses the voltage supply at power-up. The resulting power supply indication can be used by the voltage-sensitive circuitry. For instance, the power supply indication can be used to indicate the power supply level to an input buffer as disclosed in Ser. No. 07/972,971, filed Nov. 6, 1992, assigned to the assignee of the present invention. This occurs without user intervention. By allowing the voltage detector circuitry to sense the power supply immediately after power-up, the trip-points of the input buffers before any input is sampled.

In the currently preferred embodiment, since the selection of the input buffer trip-point is done automatically, a production engineer can test the 3 volt and 5 volt timing specifications without changing the user equations for the voltage in high and low and without using a different set of test programs for the 3 volt and 5 volt testing. In the prior art, the generation of a different set of test programs involves much overhead and man hours, which ultimately may result in longer wafer sorting time and, thus, slower chip production throughout.

Whereas many alterations and applications of the present invention will no doubt become apparent to a person of ordinary skill in the art after having read the foregoing description, it is understood that the particular embodiment shown and described by illustration is in no way intended to be limiting. Therefore, reference to details of the preferred embodiments are not intended to limit the scope of the claims which themselves recite only those features regarded as essential to the invention.

Thus, a voltage detector control circuitry has been described.

I claim:

1. A circuit for detecting voltage on a integrated circuit comprising:

differential amplifier means for comparing a first voltage supply and a second voltage supply, wherein the first voltage supply is a predetermined voltage supply level and the second voltage supply is capable of being the predetermined voltage supply level or at least one other voltage supply level, and further wherein said differential amplifier means magnifies the difference between the first voltage supply and the second voltage supply to accentuate the difference between the predetermined voltage supply and the second voltage supply, said differential amplifier outputting a first signal in a first logic state if the first and second voltage supplies are equal and outputting the first signal in a second logic state if the first and second voltage supplies are not equal;

output means coupled and responsive to the first signal from the differential amplifier means, such that the output means outputs a second signal indicative of the voltage supply level in response to the first signal.

2. The voltage detector as defined in claim 1 further comprising disabling means coupled to said differential amplifier means, said disabling means for disabling said differential amplifier means after said output means outputs said second signal.

3. The voltage detector as defined in claim 2 wherein the second signal is at a third logic state if the first and second voltage supplies are equal and is at a fourth logic state if the first and second voltage supplies are not equal, and wherein the voltage detector further comprises means for retaining the logic state of said second signal after said means for disabling disables said voltage detector.

4. A circuit for detecting voltage on a integrated circuit comprising:

differential amplifier means for comparing a first voltage supply and a second voltage supply, wherein the first voltage supply is a predetermined voltage supply level and the second voltage supply is capable of being the predetermined voltage supply level or at least one other voltage supply level and further wherein said differential amplifier means magnifies the difference between the first voltage supply and the second voltage supply, said differential amplifier outputting a first signal in a first logic state if the first and second voltage supplies are equal and outputting the first signal in a second logic state if the first and second voltage supplies are not equal;

output means coupled and responsive to the first signal from the differential amplifier means, such that the output means outputs a second signal indicative of the voltage supply level in response to the first signal; and means for receiving the second signal and a third signal and outputting either of said second signal or said third signal, wherein the third signal indicates said at least one other voltage supply level.

5. The voltage detector as defined in claim 4 further comprising control means for controlling said means for receiving said second signal and said third signal, such that said second signal or said third signal is output in response to said control means.

6. A voltage detector for a integrated circuit having a core operate at a predetermined voltage supply level and having at least one portion of said integrated circuit capable of operating at either the predetermined voltage supply level or at least one other voltage supply level, said voltage detector comprising:

differential amplifier means for comparing said predetermined voltage supply level and the voltage supply of at least one portion, said differential amplifier outputting a first signal in a first logic state if the first and second voltage supplies are equal and outputting the first signal in a second logic state if the first and second voltage supplies are not equal;

latching means coupled to said differential amplifier means for latching the state of the first signal and outputting a second signal indicative of said first signal, wherein the second signal is at a third logic state if the first and second voltage supplies are equal and is at a fourth logic state if the first and second voltage supplies are not equal;

disabling means coupled to said differential amplifier means and said latching means, said disabling means for disabling said differential amplifier means and said latching means;

means for receiving said second signal and retaining said logic state of said second signal, such that said logic state of said second signal is retained when said latching means and said differential amplifier means are disabled.

7. The voltage detector as defined in claim 6 wherein said output means comprising an inverter.

8. The voltage detector as defined in claim 6 further comprising means for receiving the second signal and a third signal and outputting either of said second signal or said third signal, wherein the third signal indicates said at least one other voltage supply level.

9. The voltage detector as defined in claim 8 further comprising control means for controlling said means for receiving said second signal and said third signal, such that said second signal or said third signal is output in response to said control means.

10. The voltage detector as defined in claim 8 wherein said means for receiving and outputting comprises a multiplexer.

11. The voltage detector as defined in claim 10 further comprising control means for controlling said means for receiving said second signal and said third signal, such that said second signal or said third signal is output in response to said control means.

12. The voltage detector as defined in claim 8 wherein said means for receiving comprises a pair of pass gates, wherein said second signal is received by one of said pair and said third signal is received by the other of said pair, said pass gates outputting a fourth signal indicative of said at least one other voltage supply level.

13. The voltage detector as defined in claim 12 further comprising control means for controlling said means for receiving said second signal and said third signal, such that said second signal or said third signal is output in response to said control means.

14. The voltage detector as defined in claim 6 wherein said differential amplifier means includes a load.

15. The voltage detector as defined in claim 14 wherein said load comprises a current mirror.

16. A voltage detector for a integrated circuit having a core operate at a predetermined voltage supply level and having at least one portion of said integrated circuit capable of operating at either the predetermined voltage supply level or at least one other voltage supply level, said voltage detector comprising:

differential amplifier means for comparing said predetermined voltage supply level and the voltage supply of said at least one portion, wherein said predetermined voltage supply level and said voltage supply level of said at least one portion are received by inputs of the differential amplifier means as voltage references, wherein the voltage references of the inputs to said differential amplifier means leak current, such that the difference between the predetermined voltage supply and the voltage supply of at least one portion is magnified, said differential amplifier outputting a first signal in a first logic state if the first and second voltage supplies are equal and outputting the first signal in a second logic state if the first and second voltage supplies are not equal;

latching means coupled to said differential amplifier means for latching the state of the first signal and outputting a second signal indicative of said first signal, wherein the second signal is at a third logic state if the first and second voltage supplies are equal and is at a fourth logic state if the first and second voltage supplies are not equal;

disabling means coupled to said differential amplifier means and said latching means, said disabling means for disabling said differential amplifier means and said latching means;

means for receiving said second signal and retaining said logic state of said second signal, such that said logic state of said second signal is retained when said latching means and said differential amplifier means are disabled.

* * * * *

UNITED STATES PATENT AND TRADEMARK OFFICE

CERTIFICATE OF CORRECTION

PATENT NO. : 5,343,086

DATED : August 30, 1994

INVENTOR(S) : Wing-Cho Fung, et al

It is certified that error appears in the above-indentified patent and that said Letters Patent is hereby corrected as shown below:

Column 5, line 39, Delete "trip point"; Insert in place thereof --trip-point--

Column 11, line 27, Delete "." After "0"

Signed and Sealed this

Fourteenth Day of November, 1995

*Attest:*

*Attesting Officer*

BRUCE LEHMAN

*Commissioner of Patents and Trademarks*